US005811717A

United States Patent [19]

Day et al.

[11] Patent Number: 5,811,717

[45] Date of Patent: Sep. 22, 1998

[54] POWDER-ACTUATED TOOL CARTRIDGE CLIP WITH POSITION INDICATOR MARK

[75] Inventors: R. Nolan Day, Wayne; David Forsell, Carol Stream, both of Ill.

[73] Assignee: Illinois Tool Works Inc., Glenview, Ill.

[21] Appl. No.: 701,302

[22] Filed: Aug. 21, 1996

[51] Int. Cl.[6] ..... F42B 39/08; B65D 85/00; B25C 5/00

[52] U.S. Cl. ..... 89/35.01; 206/347; 206/459.5; 227/136; 42/1.01

[58] Field of Search ..... 89/35.01; 42/1.01, 42/1.02; 227/9, 10, 11, 136; 224/223; 206/345, 346, 347, 459.5; 102/430, 281

[56] References Cited

U.S. PATENT DOCUMENTS

| | | | |
|---|---|---|---|
| 1,650,908 | 11/1927 | Ramsey | 102/430 |
| 2,828,568 | 4/1958 | Sakewitz | 42/1.02 |
| 3,552,625 | 1/1971 | Udert . | |
| 3,611,870 | 10/1971 | Udert . | |
| 3,670,942 | 6/1972 | Pomeroy . | |
| 3,743,159 | 7/1973 | Schneider . | |
| 3,944,068 | 3/1976 | Maier et al. . | |
| 3,991,925 | 11/1976 | Büchell . | |
| 3,999,321 | 12/1976 | Musgrave | 42/1.01 |
| 4,066,199 | 1/1978 | Jochum et al. . | |
| 4,109,401 | 8/1978 | Musgrave | 42/1.01 |
| 4,138,788 | 2/1979 | Jochum . | |
| 4,162,033 | 7/1979 | Pomeroy | 227/10 |
| 4,201,324 | 5/1980 | Maier et al. . | |
| 4,375,269 | 3/1983 | Bosch et al. . | |
| 4,406,079 | 9/1983 | Buechel et al. . | |
| 4,560,061 | 12/1985 | Haytayan | 206/347 |
| 4,565,114 | 1/1986 | Burdick et al. | 89/35.01 |
| 4,655,380 | 4/1987 | Haytayan . | |
| 4,821,938 | 4/1989 | Haytayan | 227/10 |
| 4,881,643 | 11/1989 | Pfister . | |
| 5,036,746 | 8/1991 | Ehmig et al. . | |
| 5,046,396 | 9/1991 | Pfister . | |
| 5,206,444 | 4/1993 | Oliver | 42/1.02 |
| 5,251,532 | 10/1993 | Frommelt et al. . | |
| 5,279,201 | 1/1994 | Jena et al. | 89/35.01 |
| 5,363,736 | 11/1994 | Huang . | |

*Primary Examiner*—Michael J. Carone
*Assistant Examiner*—Theresa M. Wesson
*Attorney, Agent, or Firm*—Schwartz & Weinrieb

[57] ABSTRACT

A powder-actuated tool cartridge clip comprising a generally elongate body member having major and minor dimensions, a plurality of explosive charge retaining receptacles arranged in series and an indexing member both disposed along the major dimension of the elongate body member. The cartridge clip is disposable in a feed channel of a powder-actuated tool of the type having an indexing mechanism for engaging and advancing the cartridge clip through the feed channel so as to sequentially position explosive charges retained at the cartridge clip in a discharge position. The cartridge clip also includes an indicator mark disposed along the elongate body member for indicating that a last remaining explosive charge retained in the cartridge clip is positioned at the discharge position or has been discharged when the portion of the cartridge clip having discharged explosive charges protrudes from the powder-actuated tool.

31 Claims, 1 Drawing Sheet

POWDER-ACTUATED TOOL CARTRIDGE CLIP WITH POSITION INDICATOR MARK

FIELD OF THE INVENTION

The present invention relates generally to powder-actuated tool cartridge clips, and more particularly to an elongate plastic powder-actuated tool cartridge clip with an indicator mark for indicating a particular position of the cartridge clip when the same is disposed or loaded within a cartridge feed channel of a powder-actuated tool.

BACKGROUND OF THE INVENTION

Powder-actuated tools generally include a piston or other drive member propelled along a barrel by an explosive charge, which when discharged drives an anchoring element or fastener into a relatively hard target material such as concrete. In some applications the explosive charge is disposed in a casing to form a cartridge which is retained in an aperture of an elongate cartridge magazine, or cartridge clip, wherein the cartridge is arranged in a series along with several other cartridges retained in corresponding apertures as disclosed in U.S. Pat. No. 3,611,870 entitled "Cartridge Magazine Construction" issued 12 Oct. 1971 to Udert and as also disclosed in U.S. Pat. No. 3,743,159 entitled "Cartridge-Actuated Fastener-Driving Tools" issued 13 Jan. 1972 to Schneider. In other applications, elongate cartridge clips have a series of apertures that retain cartridges each having a caseless explosive charge disposed in a sleeve-like holder as disclosed in U.S. Pat. No. 4,406,079 entitled "Magazine for Caseless Propellant Charges" issued 27 Sep. 1983 to Buechel et al.

Generally, elongate cartridge clips are advanced through a feed channel of the powder-actuated tool by an indexing mechanism that engages an indexed edge or surface portion along one or both sides of the clip. The cartridge clip is usually loaded into the feed channel through an inlet defined within a bottom portion of the powder-actuated tool, and the indexing mechanism incrementally advances the cartridge clip upwardly through the feed channel so as to sequentially position each explosive charge, or cartridge, in a discharge position between an ignition chamber and a firing pin. The barrel and ignition chamber form an assembly that is usually slidable against the bias of a spring member relative to the feed channel and the firing pin so as to dispose and seat a cartridge in the discharge chamber upon depressing an end portion of the barrel against a surface of the target material. The firing pin is typically actuatable by a trigger so as to discharge the cartridge in the discharge chamber. The cartridge clip continues to advance upwardly and out of the feed channel through an outlet defined within an upper portion of the powder-actuated tool as subsequent cartridges are discharged. Some cartridge clips have a lead end which must be inserted first into the feed channel inlet, whereas other cartridge clips are symmetric in the sense that either end may be inserted first into the feed channel inlet. Examples of powder-actuated tools having one or more of the above referenced features are disclosed in U.S. Pat. No. 3,552,625 entitled "Explosive Charge Operated Setting Tool or Gun" issued 5 Jan. 1971 to Udert and also in U.S. Pat. No. 3,743,159 entitled "Cartridge-Actuated Fastener-Driving Tools" issued 13 Jan. 1972 to Schneider.

Existing power-actuated tools utilizing elongate cartridge clips of the types discussed generally above do not automatically eject a spent cartridge clip from the tool after the last cartridge is discharged. At present, the spent cartridge clip must be removed manually from the powder-actuated tool. The inventors of the present invention recognize, however, that operators of powder-actuated tools are not always aware of the status of the cartridges, or explosive charges, remaining in the cartridge clip in the feed channel, and more particularly whether or not the last cartridge has been discharged. Operators of present powder-actuated tools therefore do not always know when to remove the cartridge clip from the feed channel. The problem results in part because it is not readily apparent whether the cartridge clip is indexed, or positioned, in the feed channel for discharging the last cartridge or whether the last cartridge has been discharged based on a casual visual inspection of the cartridge strip portion protruding from the feed channel outlet of the tool. This uncertainty often results in inefficient operation of the tool and sometimes gives rise to hazardous conditions, which may result in tool malfunction, property damage and personal injury. More specifically, an operator not knowing the status of the cartridge clip may, for example, remove the cartridge clip from the tool for inspection, which may be an unnecessary waste of time and may result in wasted cartridges. Also, subsequent attempts may be made to re-feed a partially spent cartridge clip back into the feed channel, which is not always permissible and may pose a hazard. It is also possible, in some instances, to inadvertently load a second fastener into the barrel after inspecting or replacing the cartridge clip, wherein the second fastener is loaded into the barrel in addition to a first fastener previously loaded into the barrel. Discharge of a tool with more than one fastener load into the barrel may result in malfunction of the tool and is generally considered an improper use of the tool, which is not recommended.

In view of the discussion above among other considerations, there exists a demonstrated need for an advancement in the art of elongate cartridge clips for powder-actuated tools.

OBJECTS OF THE INVENTION

It is therefore an object of the invention to provide a novel elongate cartridge clip for powder-actuated tools that overcomes the problems with the prior art.

It is also an object of the invention to provide a novel elongate cartridge clip with cartridges retained in series along the elongate body member and an indicator mark disposed along the elongate body member for indicating a particular position of the cartridge clip in a feed channel of a powder-actuated tool when a portion of the cartridge clip protrudes from the powder-actuated tool.

It is another object of the invention to provide a novel elongate cartridge clip with cartridges retained in series along the elongate body member and an indicator mark located on the elongate body member to indicate that a last remaining cartridge retained in the cartridge clip is positioned in the discharge position or that the last cartridge has been discharged when a predetermined portion of the cartridge clip having discharged cartridges protrudes from the powder-actuated tool.

SUMMARY OF THE INVENTION

The present invention is, accordingly, drawn to a powder-actuated tool cartridge clip comprising generally an elongate body member having a major dimension and a minor dimension, a plurality of explosive charge-retaining receptacles arranged in series along the major dimension of the elongate body member, and an indexing member also disposed along the major dimension of the elongate body member. The cartridge clip is disposable generally in a feed channel of a powder-actuated tool of the type having an indexing mechanism for engaging and advancing the cartridge clip through the feed channel so as to sequentially position cartridges retained in the cartridge clip in a discharge position. The cartridge clip also includes an indicator mark disposed along the elongate body member for indicating that a last remaining cartridge retained in the cartridge clip is positioned in the discharge position or that the last cartridge has been discharged when a predetermined portion of the cartridge clip having discharged cartridges protrudes from the powder-actuated tool.

BRIEF DESCRIPTION OF THE DRAWINGS

These and other objects, features and advantages of the present invention will become more fully apparent upon consideration of the following Detailed Description of the Invention with the accompanying drawings, which may be disproportionate for ease of understanding, and wherein like structure and steps are referenced by corresponding numerals and indicators throughout the several views, and wherein.

DETAILED DESCRIPTION OF THE INVENTION

Figure 1A:
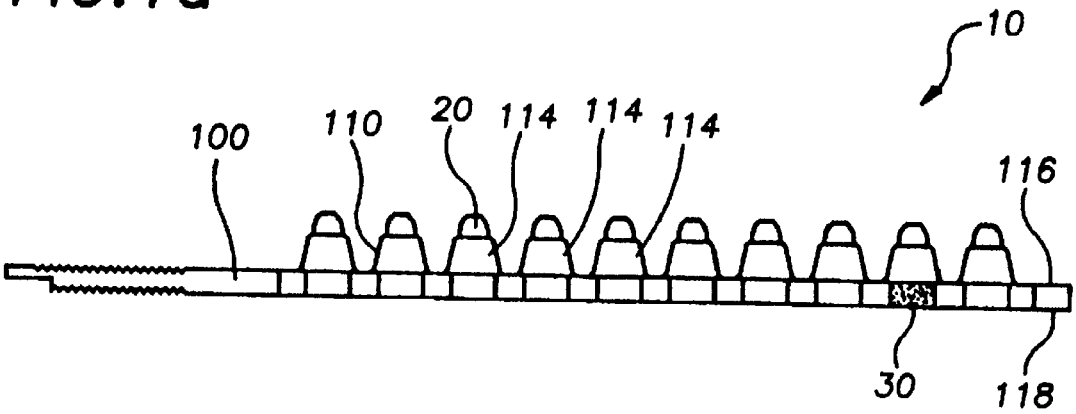
FIG. 1*a* is a side view of a powder-actuated cartridge clip with a cartridge status indicator mark according to an exemplary embodiment of the invention.
Figure 1B:
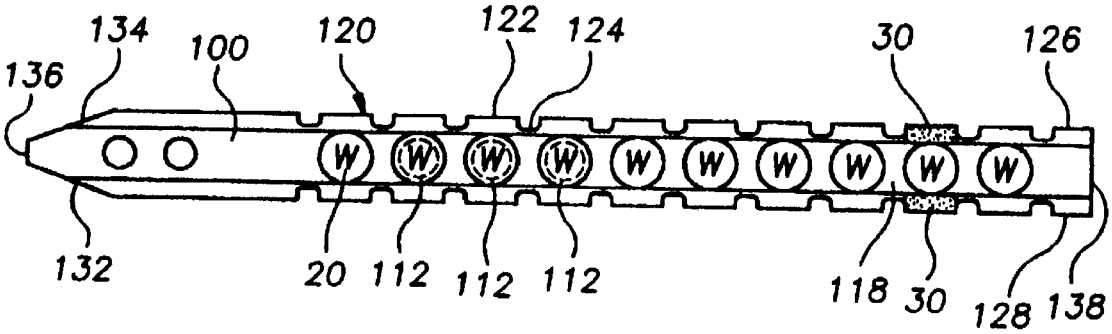
FIG. 1*b* is a bottom view of the powder-actuated cartridge clip with the cartridge status indicator mark of FIG. 1*a*.

FIGS. 1*a* and 1*b* are views of an exemplary powder-actuated tool cartridge clip 10 comprising a generally elongate body member 100 having a major dimension and a minor dimension, a plurality of explosive charge retaining receptacles 110 arranged in series along the major dimension of the elongate body member 100, and an indexing member 120 also disposed along the major dimension of the elongate body member 100. The cartridge clip 10 is disposable in a feed channel of a powder-actuated tool of the type having an indexing mechanism for engaging and advancing the cartridge clip 10 through the feed channel so as to sequentially position cartridges 20 retained in the cartridge clip 10 at a discharge position, which is usually proximate a discharge chamber and a firing pin, not shown in the drawing. The cartridge clip 10 also includes an indicator mark 30 disposed along the elongate body member 100 for indicating the position of the cartridge clip 10 disposed within the feed channel of the powder-actuated tool when a portion of the cartridge clip 10 with the indicator mark 30 protrudes from the powder-actuated tool.

The explosive charge retaining receptacles 110 are substantially equally spaced along the major dimension of the elongate body member 100 so as to permit accurate sequential positioning of adjacent explosive charges, or cartridges 20 at the discharge position as the cartridge strip 10 is advanced through the feed channel of the powder-actuated tool. The plurality of explosive charge retaining receptacles 110 of the exemplary embodiments is a plurality of substantially circular apertures 112, shown in phantom, with an annular sleeve portion 114 protruding from a first face 116 opposite a second face 118 of the elongate body member 100. The circular apertures 112 are configured for receiving and retaining an explosive charge of the type disposed within a casing, referred to generally as a cartridge as discussed above. In alternative embodiments, however, the explosive charge retaining receptacles may be apertures having other shapes with or without the protruding annular portions 114 for retaining other types of explosive charges including casingless explosive charges. More generally, the plurality of explosive charge retaining receptacles 110 may be any structure that retains a plurality of corresponding explosive charges arranged in a series along the major dimension of the elongate body member 100 for sequentially positioning each explosive charge at the firing position in the powder-actuated tool as the cartridge clip 10 is advanced along the feed channel of the powder-actuated tool.

The indexing member 120 of the exemplary embodiments comprises a plurality of teeth 122 defined by a plurality of recesses 124 formed along at least one of first and second substantially opposite lateral side portions 126 and 128 disposed along the major dimension of the elongate body member 100. The teeth 122 are substantially equally spaced so as to permit substantially equivalent incremental advancements of the cartridge clip 10 through the feed channel of the powder-actuated tool. The teeth 122 of the exemplary embodiments are substantially rectangular teeth, but alternative embodiments may include saw-tooth shapes and other configurations. More generally, however, the indexing member 120 may be any structure that is cooperatively engageable with the indexing mechanism of the powder-actuated tool so as to incrementally advance the cartridge clip 10 along the feed channel in substantially equal increments for sequentially positioning each explosive charge at the firing position in the power-actuated tool as the cartridge clip 10 is advanced along the feed channel.

In the cartridge clip 10 of the exemplary embodiments, the first and second lateral side portions 126 and 128 along the major dimension of the elongate body member 100 have tapered portions 132 and 134 narrowing conically or arcuately toward an end portion 136 to form a lead end portion 136 which is insertable first into the feed channel of the powder-actuated tool, wherein the first end portion 136 is opposite a second opposite end portion 138. In alternative embodiments, one or both end portions 136 and 138 of the cartridge clip 10 are configured for insertion into the feed channel of the powder-actuated tool. In one embodiment, both end portions 136 and 138 have a substantially squared configuration, as does end portion 138 of the exemplary embodiment. More generally, however, the end portions 136 and 138 of the elongate body member may have any configuration so long as the cartridge clip 10 is insertable into and incrementally advanceable along the feed channel of a power-actuated tool as discussed above.

The cartridge clip indicator mark 30 is disposed along the elongate body member 100 for indicating a predetermined position of the cartridge clip 10 within the feed channel of a powder-actuated tool when a portion of the cartridge clip 10 with the indicator mark 30 protrudes from the powder-actuated tool. In one configuration, the indicator mark is located along the elongate body member 100 so as to indicate that a last remaining cartridge 20 retained in the cartridge clip 10 is positioned at the discharge position when the major portion of the cartridge clip 10 with discharged cartridges 20 and the indicator mark 30 protrude from the powder-actuated tool. In another configuration, the indicator mark 30 indicates that a last cartridge 20 has been discharged. The specific location of the indicator mark 30 along the cartridge clip 10 is dependant on the particular type of powder-actuated tool within which the clip 10 is loaded and on the status the indicator mark 30 is intended to signal. Generally, the indicator mark 30 is disposed on a surface of the cartridge strip 10 that is most readily visible to an operator of the powder-actuated tool when the cartridge clip 10 protrudes from the feed channel of the powder-actuated tool. In many applications the second face 118 of the elongate body member 100 is the most readily visible surface of the cartridge clip 10.

Figure 2:
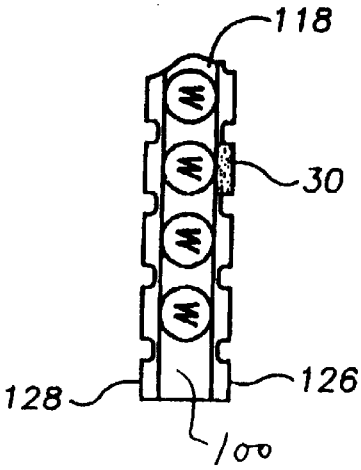
FIG. 2 is a partial bottom view of a powder-actuated cartridge clip with a cartridge status indicator mark according to an alternative exemplary embodiment of the invention.
Figure 3:
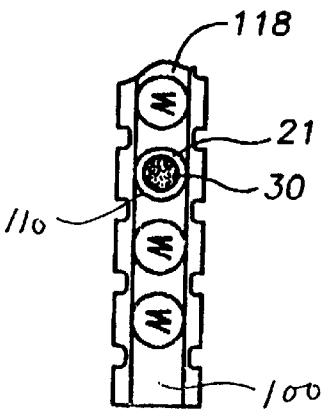
FIG. 3 is a partial bottom view of a powder-actuated cartridge clip with a cartridge status indicator mark on a cartridge retained in the cartridge clip according to another alternative exemplary embodiment of the invention.

The cartridge clip 10 of the exemplary embodiment of FIGS. 1*a* and 1*b* includes ten explosive charge-retaining receptacles 110 wherein the first explosive charge retaining receptacle is nearest the lead end 136 of the cartridge clip 10 and the tenth explosive charge-retaining receptacle is farthest from the lead end 136 of the cartridge clip 10. In the exemplary embodiment of FIGS. 1*a* and 1*b* the indicator mark 30 is disposed proximate a ninth explosive charge-retaining receptacle on both the first and second lateral side portions 126 and 128 and on the face 119 of the elongate body member 100 so as to indicate that a last remaining explosive charge is positioned in the tool for discharge. The indicator mark 30 may be disposed alternatively on only one or the other of the first and second lateral side portions 126 and 128 and on the second face 118 of the elongate body member 100 as shown in FIG. 2. Also, the indicator mark may alternatively or cumulatively be disposed on a cartridge 21 retained in the receptacle 110 of the elongate body member 100 as shown in FIG. 3. Combinations of the above configurations are also possible.

Figure 4:
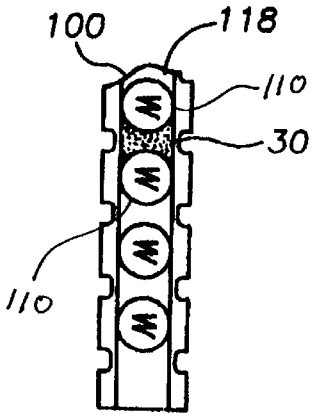
FIG. 4 is a partial bottom view of a powder-actuated cartridge clip with a cartridge status indicator mark between cartridges retained in the cartridge clip according to yet another alternative exemplary embodiment of the invention.

In the alternative embodiment of FIG. 4, the indicator mark 30 is disposed between explosive charge retaining receptacles 110 on the second face 118 of the elongate body member 100. In one embodiment the indicator mark is disposed between the seventh and eighth explosive charge retaining receptacles 110 as counted from the lead end portion 136 shown in FIG. 1 so as to indicate that a last remaining explosive charge is positioned at the discharge position of the powder-actuated tool.

In embodiments where either end 136 and 138 is first insertable into the feed channel of the powder-actuated tool, an indicator mark 30 may be disposed on both ends of the cartridge clip 10, wherein the indicator mark 30 has any one or more of the configurations discussed above, so as to indicate that the last remaining cartridge is disposed at the discharge position within the feed channel of the powder-actuated tool regardless of which end of the cartridge clip 10 is first inserted into the power-actuated tool. According to this alternative configuration, two indicator marks 30 will be visible on the portion of the cartridge clip 10 protruding from the outlet of the feed channel of the tool when the last remaining cartridge in the cartridge clip 10 is disposed at the discharge position of the powder-actuated tool, wherein the indicator mark 30 nearest the tool is indicative of the position of the cartridge clip 10.

The cartridge clip 10 is generally formed of a plastic material or other material suitably fabricatable for retaining explosive charges and operating as discussed above, and the indicator mark 30 is generally formed of a visually perceptible material that is readily adherable to the cartridge clip 10. The indicator mark 30 may be an ink, or dye, or highly reflective material, or other substance that is not readily subject to fading and removal resulting from handling and operation of the power-actuated tool. The indicator mark 30 preferably contrasts well with the cartridge clip 10 to provide a readily noticeable visual stimulus. The indicator mark 30 may be stamped, or printed, or otherwise adhered to the cartridge clip 10 or to the cartridge 20 in any combination of configurations discussed above.

While the foregoing written description of the invention enables anyone skilled in the art to make and use what is at present considered to be the best mode of the invention, it will be appreciated and understood by anyone skilled in the art the existence of variations, combinations, modifications and equivalents within the spirit and scope of the specific exemplary embodiments disclosed herein. The present invention therefore is to be limited not by the specific exemplary embodiments disclosed herein but by all embodiments within the scope of the appended claims.

What is claimed is:

1. A powder-actuated tool cartridge clip disposable in a feed channel of a powder-actuated tool having an indexing mechanism for advancing the cartridge clip through the feed channel so as to sequentially position explosive charges retained within the cartridge clip at a discharge position, comprising:

an elongate body member having a major dimension and a minor dimension;

a plurality of explosive charge-retaining receptacles arranged in series along said major dimension of said elongate body member;

indexing means disposed along said major dimension of said elongate body member for engagement by an indexing mechanism of a powder-actuated tool; and indicator means disposed at a predetermined position upon said elongate body member for indicating the position of said cartridge clip within a feed channel of a powder-actuated tool when a portion of said elongate body member of said cartridge clip, having said indicator means disposed thereon, protrudes externally from the feed channel of the powder-actuated tool.

2. The cartridge clip of claim 1 wherein the indicator means is located on the elongate body member so as to indicate that a last remaining explosive charge retained in the cartridge clip is positioned in the discharge position when the portion of the cartridge clip having discharged explosive charges disposed thereon protrudes from the powder-actuated tool.

3. The cartridge clip of claim 1 wherein the indicator means is located on the elongate body member so as to indicate that a last remaining explosive charge retained in the cartridge clip has been discharged when the portion of the cartridge clip having discharged explosive charges disposed thereon protrudes from the powder-actuated tool.

4. The cartridge clip of claim 1, wherein:

said elongate body member comprises first and second faces, first and second lateral side portions, and first and second end portions; and said indicator means is disposed upon at least one of said first and second faces of said elongate body member, said first and second lateral side portions of said elongate body member, and a casing retained in a charge retaining receptacle of said elongate body member.

5. The cartridge clip of claim 1, wherein:

first and second lateral side portions disposed along said major dimension of said elongate body member have tapered portions narrowing toward each other across said minor dimension of said elongate body member and extending toward one of first and second opposite end portions of said elongate body member so as to form a leading end portion upon said elongate body member for facilitating guidable insertion of said elongate body member into the feed channel of the powder-actuated tool.

6. The cartridge clip of claim 1 wherein the indexing means comprises a plurality of teeth defined by a plurality of recesses formed along at least one of first and second lateral side portions disposed along the major dimension of the elongate body member whereby the indexing mechanism of the powder-actuated tool is engageable with the plurality of teeth so as to incrementally advance the cartridge clip through the feed channel.

7. The cartridge clip as set forth in claim 6, wherein:

said plurality of teeth, comprising said indexing means, are disposed in a serial arrangement upon both of said first and second lateral side portions of said elongate body member.

8. The cartridge clip as set forth in claim 6, wherein:

each one of said plurality of teeth has a substantially rectangular configuration.

9. The cartridge clip of claim 1 wherein the plurality of explosive charge retaining receptacles are apertures with an annular sleeve portion protruding from a first face of the elongate body member.

10. The cartridge clip of claim 1, wherein:

said elongate body member comprises first and second faces, first and second lateral side portions, and first and second end portions:

said cartridge clip includes ten explosive charge retaining receptacles, the first explosive charge retaining receptacle is disposed nearest a leading end of the cartridge clip and the tenth explosive charge retaining receptacle is disposed farthest from the leading end of the cartridge clip; and said indicator means is located proximate the eighth explosive charge retaining receptacle and is disposed upon at least one of said first and second faces of said elongate body member, said first and second lateral side portions of said elongate body member, and a casing retained within said eighth explosive charge retaining receptacle.

11. The cartridge clip of claim 10, wherein:

first and second lateral side portions disposed along said major dimension of said elongate body member have tapered portions narrowing toward each other across said minor dimension of said elongate body member and extending toward one of first and second opposite end portions of said elongate body member so as to form said leading end portion of said cartridge clip for facilitating guidable insertion of said cartridge clip into the feed channel of the powder-actuated tool.

12. The cartridge clip of claim 1, wherein:

said cartridge clip includes ten explosive charge-retaining receptacles;

the first explosive charge-retaining receptacle is disposed nearest a leading end of said cartridge clip and the tenth explosive charge-retaining receptacle is disposed farthest from said leading end of said cartridge clip; and said indicator means is disposed between the seventh and eighth explosive charge-retaining receptacles.

13. The cartridge clip of claim 12, wherein:

first and second lateral side portions disposed along said major dimension of said elongate body member have tapered portions narrowing toward each other across said minor dimension of said elongate body member and extending toward one of first and second opposite end portions of said elongate body member so as to form said leading end portion upon said elongate body member for facilitating guidable insertion of said elongate body member into the feed channel of the powder-actuated tool.

14. The cartridge clip as set forth in claim 1, wherein:

said cartridge clip comprises ten explosive charge-retaining receptacles wherein the first explosive charge-retaining receptacle is disposed nearest a leading end of said cartridge clip while the tenth explosive charge-retaining receptacle is disposed farthest from said leading end of said cartridge clip; and said indicator means is disposed proximate the ninth explosive charge-retaining receptacle.

15. The cartridge clip as set forth in claim 14, wherein:

first and second lateral side portions disposed along said major dimension of said elongate body member have tapered portions narrowing toward each other across said minor dimension of said elongate body member and extending toward one of first and second opposite end portions of said elongate body member so as to form said leading end portion of said cartridge clip for facilitating guidable insertion of said cartridge clip into the feed channel of the powder-actuated tool.

16. The cartridge clip as set forth in claim 15, wherein:

said indicator means is disposed upon each one of said first and second lateral side portions of said elongate body member so as to be disposed upon opposite sides of said ninth explosive charge-retaining receptacle.

17. The cartridge clip as set forth in claim 1, wherein:

said cartridge clip comprises ten explosive charge-retaining receptacles wherein the first explosive charge-retaining receptacle is disposed nearest a leading end of said cartridge clip while the tenth explosive charge-retaining receptacle is disposed farthest from said leading end of said cartridge clip; and said indicator means is disposed proximate the eighth explosive charge-retaining receptacle.

18. The cartridge clip as set forth in claim 17, wherein:

said indicator means is disposed upon a casing retained within said eighth explosive charge-retaining receptacle.

19. The cartridge clip as set forth in claim 17, wherein:

first and second lateral side portions disposed along said major dimension of said elongate body member have tapered portions narrowing toward each other across said minor dimension of said elongate body member and extending toward one of first and second opposite end portions of said elongate body member so as to form said leading end portion upon said elongate body member for facilitating guidable insertion of said elongate body member into the feed channel of the powder-actuated tool.

20. The cartridge clip as set forth in claim 19, wherein:

said indicator means is disposed upon one of said lateral side portions of said elongate body member so as to be disposed upon one side of said eighth explosive charge-retaining receptacle.

21. The cartridge clip as set forth in claim 1, wherein:

said cartridge clip is fabricated from a plastic material.

22. The cartridge clip as set forth in claim 1, wherein:

said indicator means comprises an indicator mark which is visually perceptible and which is selected from the group comprising an ink, a dye, and a highly reflective material.

23. A powder-actuated tool cartridge clip disposable in a feed channel of a powder-actuated tool having an indexing mechanism for advancing the cartridge clip through the feed channel of the powder-actuated tool so as to sequentially position explosive charges retained within the cartridge clip at a discharge position, comprising:

an elongate body member having a major dimension and a minor dimension, and having a leading end for insertion into the feed channel of the powder-actuated tool, and a trailing end;

a plurality of explosive charge-retaining receptacles arranged in series along said major dimension of said elongate body member so as to be disposed between said leading and trailing ends of said elongate body member;

indexing means disposed along said major dimension of said elongate body member for engagement by an indexing mechanism of a powder-actuated tool so as to facilitate advancement of said elongate body member, through the feed channel of the powder-actuated tool, from said leading end of said elongate body member to said trailing end of said elongate body member; and indicator means disposed at a predetermined position upon said elongate body member and within the vicinity of said trailing end of said elongate body for indicating to an operator, when a portion of said elongate body member of said cartridge clip, from which a plurality of explosive charges have already been fired and having said indicator means disposed thereon, protrudes externally from the feed channel of the powder-actuated tool while said trailing end of said elongate body member remains within the feed channel of the powder-actuated tool, that said trailing end of said elongate body member is being approached whereby said cartridge clip is being exhausted.

24. The cartridge clip as set forth in claim 23, wherein:

said cartridge clip comprises ten explosive charge-retaining receptacles wherein the first explosive charge-retaining receptacle is disposed nearest said leading end of said elongate body member and the tenth explosive charge-retaining receptacle is disposed nearest said trailing end of said elongate body member.

25. The cartridge clip as set forth in claim 24, wherein:

said indicator means is disposed proximate the eighth explosive charge-retaining receptacle.

26. The cartridge clip as set forth in claim 25, wherein:

said indicator means is disposed upon a casing retained within said eighth explosive charge-retaining receptacle.

27. The cartridge clip as set forth in claim 25, wherein:

said elongate body member comprises first and second lateral side portions; and said indicator means is disposed upon one of said lateral side portions of said elongate body member so as to be disposed upon one side of said eighth explosive charge-retaining receptacle.

28. The cartridge clip as set forth in claim 24, wherein:

said indicator means is disposed proximate the ninth explosive charge-retaining receptacle.

29. The cartridge clip as set forth in claim 28, wherein:

said elongate body member comprises first and second lateral side portions; and said indicator means is disposed upon each one of said first and second lateral side portions of said elongate body member so as to be disposed upon opposite sides of said ninth explosive charge-retaining receptacle.

30. The cartridge clip as set forth in claim 24, wherein:

said indicator means is interposed between the seventh and eighth explosive charge-retaining receptacles.

31. The cartridge clip as set forth in claim 23, wherein:

said indicator means comprises an indicator mark which is visually perceptible and which is selected from the group comprising an ink, a dye, and a highly reflective material.

* * * * *